US009717307B1

(12) United States Patent
Bulger

(10) Patent No.: US 9,717,307 B1
(45) Date of Patent: Aug. 1, 2017

(54) SHOE CLEANING ASSEMBLY

(71) Applicant: Ivone Bulger, El Cerrito, CA (US)

(72) Inventor: Ivone Bulger, El Cerrito, CA (US)

( * ) Notice: Subject to any disclaimer, the term of this patent is extended or adjusted under 35 U.S.C. 154(b) by 25 days.

(21) Appl. No.: 15/014,461

(22) Filed: Feb. 3, 2016

(51) Int. Cl.
*A43D 11/00* (2006.01)
*A43D 999/00* (2006.01)
*A43B 13/18* (2006.01)

(52) U.S. Cl.
CPC ..... *A43D 11/003* (2013.01); *A43B 13/186* (2013.01); *A43D 999/00* (2013.01)

(58) Field of Classification Search
CPC ... A43D 11/003; A43D 999/00; Y10T 156/11; Y10T 156/1174; Y10T 156/195; Y10T 156/1956; B32B 38/10; A47L 23/22; A47L 25/005
USPC ..... 12/1 R
See application file for complete search history.

(56) References Cited

U.S. PATENT DOCUMENTS 2,194,693 A * 3/1940 Dehne ..... A43D 8/40 12/7.5
3,903,620 A * 9/1975 Gillet ..... A43C 13/12 2/114
D386,858 S 11/1997 Mandish
5,771,528 A 6/1998 Nappi, Sr.
5,771,605 A * 6/1998 Safdie ..... A43D 11/003 36/132
5,950,269 A 9/1999 Openshaw et al.
6,543,075 B2 * 4/2003 Gultekin ..... A47G 25/80 12/1 R
7,108,154 B1 * 9/2006 Thompson ..... A43D 11/003 220/481
7,757,910 B2 * 7/2010 Levine ..... A43B 3/16 12/1 R
8,024,872 B2 * 9/2011 Pettis ..... A43B 13/22 36/132
8,241,565 B1 * 8/2012 Abdul ..... A61L 2/10 250/455.11
8,533,888 B2 * 9/2013 Kessler ..... A47L 23/22 15/104.92
9,210,968 B2 * 12/2015 Ianchulev et al. ..... A43D 25/06
2004/0078909 A1 * 4/2004 Coppa ..... A47L 23/26 15/104.92
2009/0152312 A1 * 6/2009 Li ..... A43B 3/16 223/113
2014/0048214 A1 * 2/2014 Dhillon ..... A43D 11/003 156/760
2014/0259459 A1 * 9/2014 Ianchulev ..... A43D 25/06 12/18.1
2014/0305470 A1 * 10/2014 Desu-Kalyanam ... A47L 23/263 134/6

* cited by examiner

*Primary Examiner* — Ted Kavanaugh

(57) ABSTRACT

A shoe cleaning assembly includes a housing that may be positioned on a support surface. The housing has a pair of openings and each of the openings may have a pair of shoes placed therein while the shoes are worn. A dispensing unit is positioned within the housing and the dispensing unit includes a plurality of adhesive pads. The plurality of adhesive pads is aligned with the openings. A selected one of the adhesive pad adheres to a sole of the pair of shoes when the shoes are positioned within the openings. Thus, the adhesive pads inhibit the sole of the pair of shoes from releasing dirt into an area.

12 Claims, 4 Drawing Sheets

SHOE CLEANING ASSEMBLY

BACKGROUND OF THE DISCLOSURE

Field of the Disclosure

The disclosure relates to cleaning devices and more particularly pertains to a new cleaning device for inhibiting a pair of shoes from releasing dirt into an area.

SUMMARY OF THE DISCLOSURE

An embodiment of the disclosure meets the needs presented above by generally comprising a housing that may be positioned on a support surface. The housing has a pair of openings and each of the openings may have a pair of shoes placed therein while the shoes are worn. A dispensing unit is positioned within the housing and the dispensing unit includes a plurality of adhesive pads. The plurality of adhesive pads is aligned with the openings. A selected one of the adhesive pad adheres to a sole of the pair of shoes when the shoes are positioned within the openings. Thus, the adhesive pads inhibit the sole of the pair of shoes from releasing dirt into an area.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
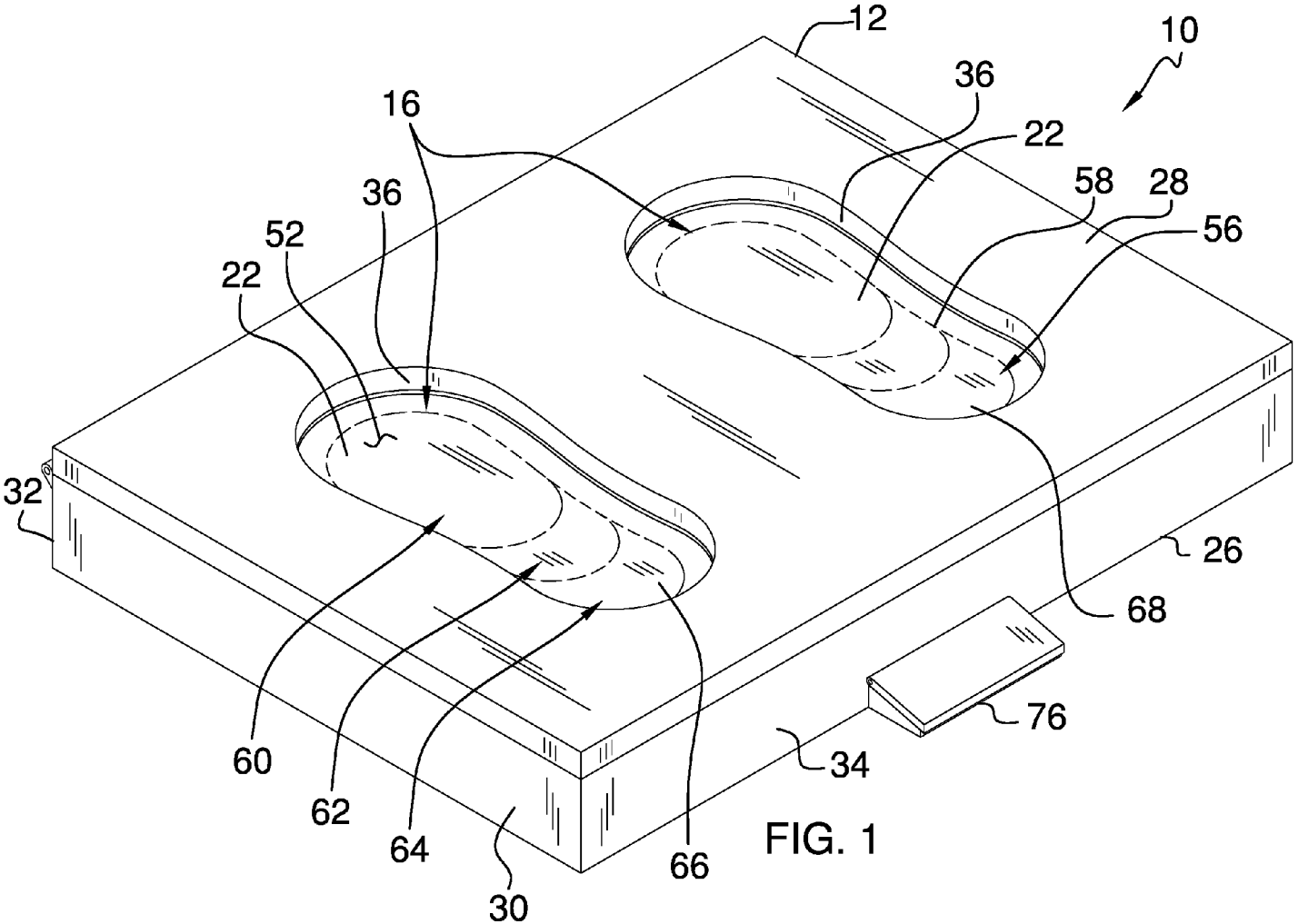
FIG. 1 is a top perspective view of a shoe cleaning assembly according to an embodiment of the disclosure.
Figure 2:
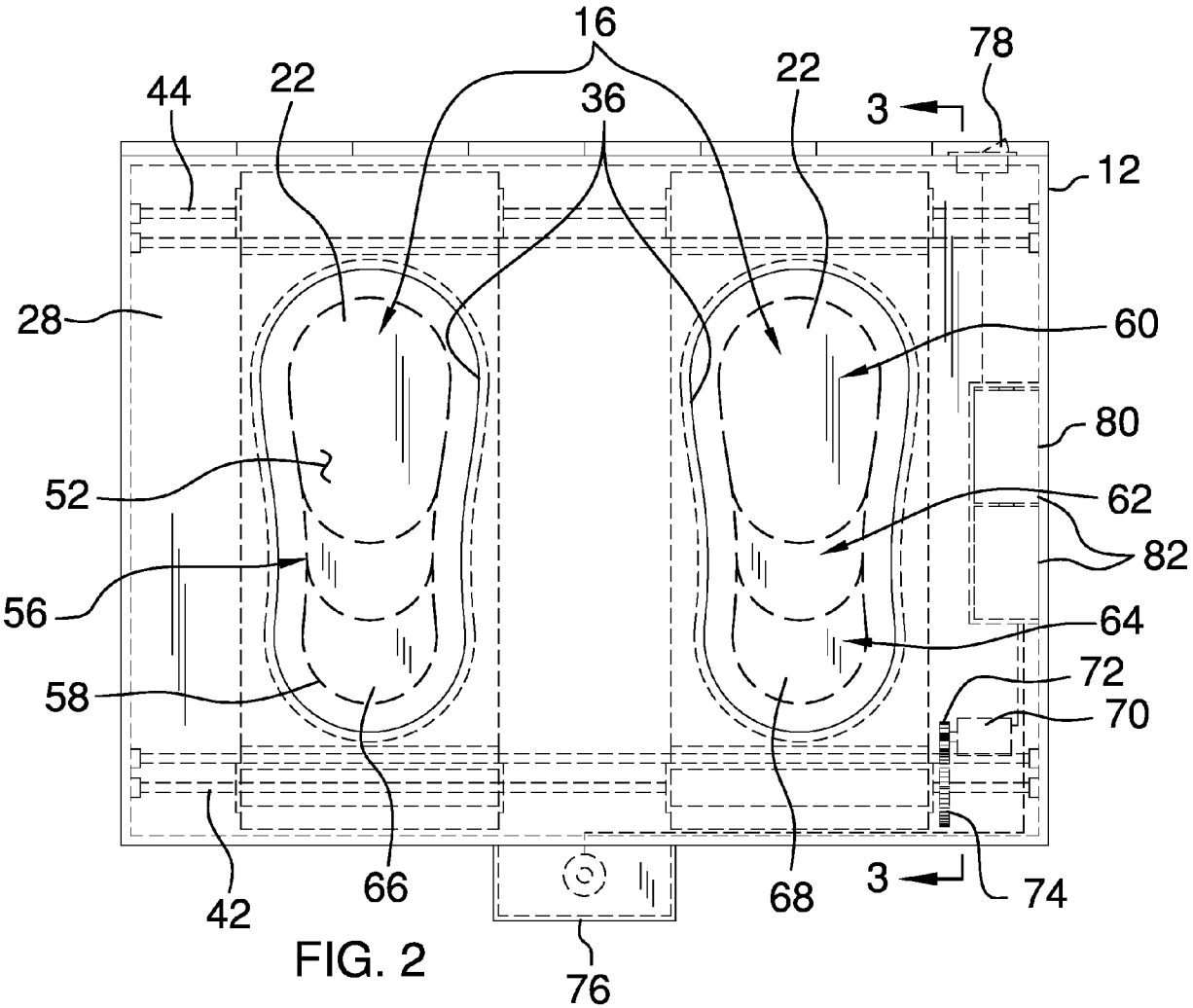
FIG. 2 is a top phantom view of an embodiment of the disclosure.
Figure 3:
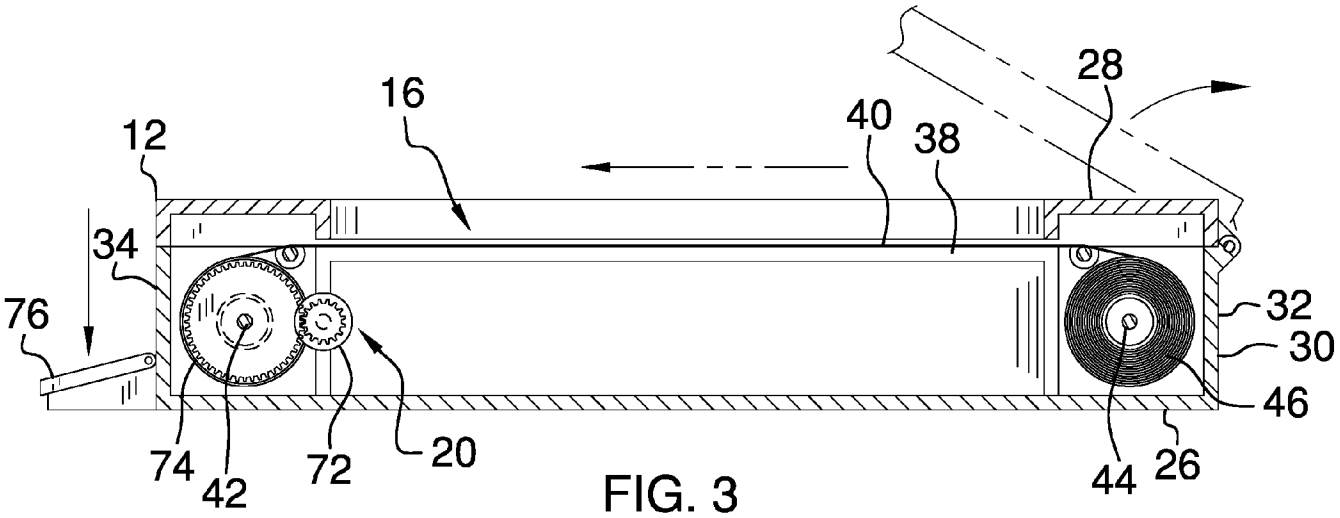
FIG. 3 is a cross sectional view taken along line 3-3 of FIG. 2 of an embodiment of the disclosure.
Figure 4:
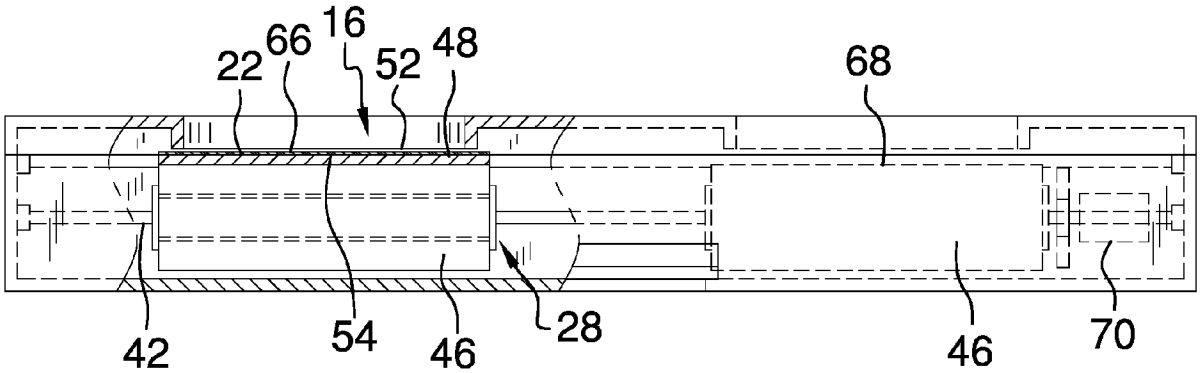
FIG. 4 is a back cut-away view of an embodiment of the disclosure.
Figure 5:
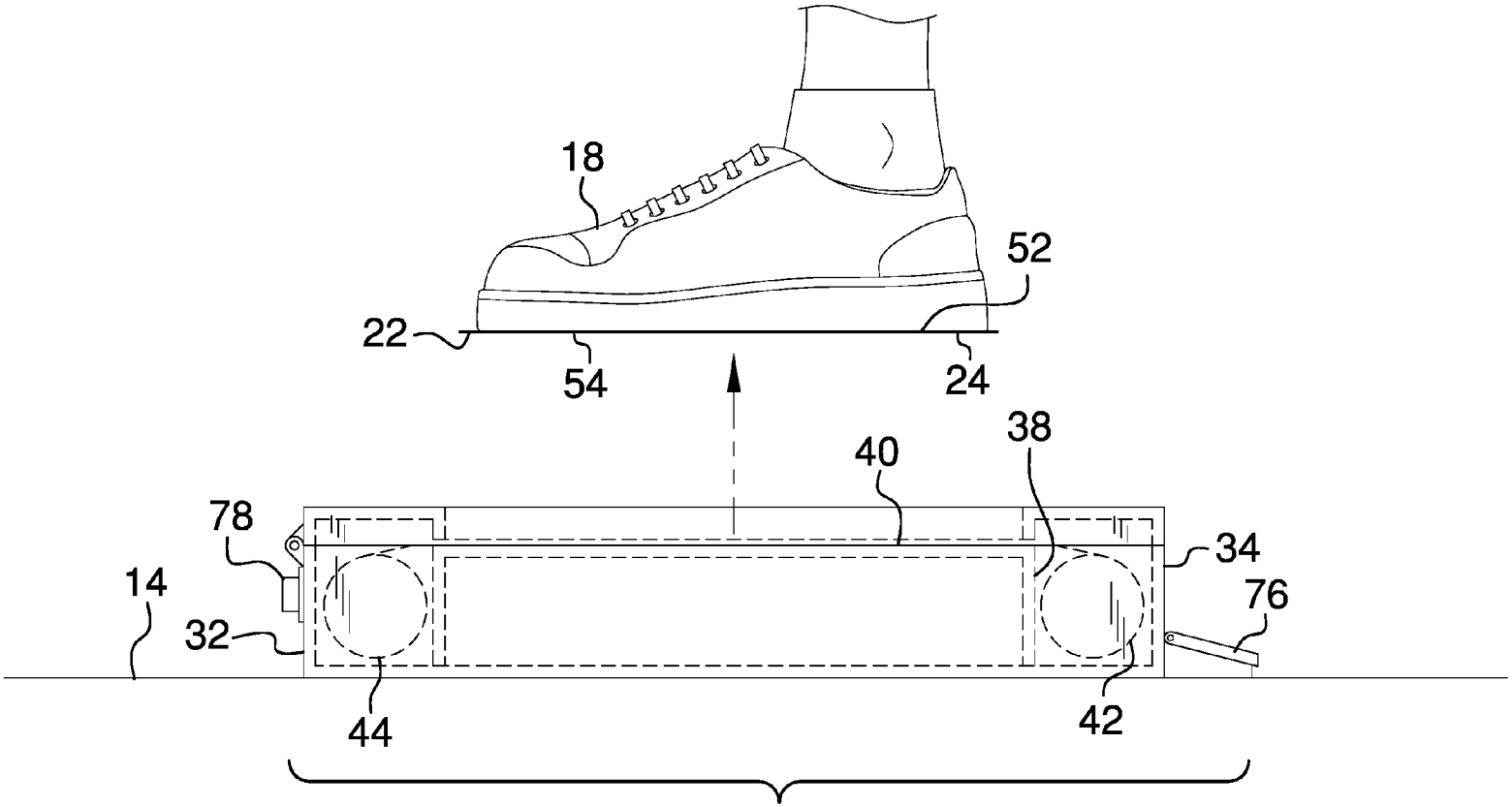
FIG. 5 is a perspective in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the shoe cleaning assembly 10 generally comprises a housing 12 that may be positioned on a support surface 14. The support surface 14 may comprise a floor or the like. The housing 12 has a pair of openings 16 therein. Each of the openings 16 may have a pair of shoes 18 placed therein while the shoes 18 are worn.

A dispensing unit 20 is positioned within the housing 12 and the dispensing unit 20 includes a plurality of adhesive pads 22. The plurality of adhesive pads 22 is aligned with the openings 16. Thus, a selected one of the adhesive pad 22 adheres to a sole 24 of the pair of shoes 18 when the shoes 18 are positioned within the openings 16. The adhesive pads 22 inhibit the sole 24 of the pair of shoes 18 from releasing dirt into an area. The area may comprise an interior of a home or the like.

The housing 12 has a bottom wall 26, a top wall 28 and a peripheral wall 30 extending between the bottom wall 26 and the top wall 28. The peripheral wall 30 has a front side 32 and a back side 34. The top wall 28 has each of the openings 16 extending therthrough and the openings 16 are spaced apart from each other. Each of the openings 16 extends substantially between the front side 32 and the back side 34. Each of the openings 16 has a bounding surface 36 and the bounding surface 36 of each of the openings 16 is continuous such that each of the openings 16 has an ovoid shape. The top wall 28 is hingedly coupled to the front side 32 and the top wall 28 is positionable in an open position to access an interior of the housing 12.

The housing 12 includes a pair of platforms 38 and each of the platforms 38 is positioned within the housing 12. Each of the platforms 38 has a top side 40. The top side 40 of each of the platforms 38 is aligned with an associated one of the openings 16. Thus, the top side 40 of each of the platforms 38 may be stood upon. The top side 40 of each of the platforms 38 is spaced from the top wall 28 of the housing 12.

The dispensing unit 20 comprises a first roller 42 that is rotatably coupled to the housing 12. The first roller 42 is positioned within an interior of the housing 12 and the first roller 42 is coextensive with the front side 32. A second roller 44 is rotatably coupled to the housing 12. The second roller 44 is positioned within the interior of the housing 12 and the second roller 44 is coextensive with the back side 34.

A pair of sheets 46 is provided and each of the sheets 46 is rolled around the second roller 44. The sheets 46 are spaced apart from each other such that each of the sheets 46 is aligned with and associated one of the openings 16. Each of the sheets 46 extends between the top side 40 of the platform 38 and the top wall 28 of the housing 12. Each of the sheets 46 extends across an entire length of the associated opening 16. Each of the sheets 46 is coupled to the first roller 42 and each of the sheets 46 has an upper surface 48 that is exposed in the associated opening 16.

Each of the plurality of adhesive pads 22 has a top surface 52 and a bottom surface 54. The top surface 52 of each of the adhesive pads 22 comprises an adhesive layer 55. Each of the adhesive pads 22 has a perforated section 56 and the perforated section 56 has a bounding surface 58. The bounding surface 58 of the perforated section 56 is continuous such that the perforated section 56 has an ovoid shape. The perforated section 56 is longitudinally divided into a first portion 60, a second portion 62 and a third portion 64. Each of the first portion 60, the second portion 62 and the third portion 64 of the perforated section accommodate a variety of sizes of the shoes.

The plurality of adhesive pads 22 comprise a first set 66 of the adhesive pads 22 and a second set 68 of the adhesive pads 22. The bottom surface 54 corresponding to first set of adhesive pads 66 is removably coupled to the upper surface 48 of an associated one of the sheets 46. Thus, the top surface 52 corresponding to the first set of adhesive pads 66 may be stepped upon. The adhesive layer 55 corresponding to the first set of adhesive pads 66 adhesively engages the sole 24 of an associated one of the shoes 18. The first set of adhesive pads 66 is distributed along the associated sheet 46.

The bottom surface 54 corresponding to second set of adhesive pads 68 is removably coupled to the upper surface 48 of an associated one of the sheets 46. Thus, the top surface 52 corresponding to the second set of adhesive pads 68 may be stepped upon. The adhesive layer 55 corresponding to the second set of adhesive pads 68 adhesively engages the sole 24 of an associated one of the shoes 18. The second set of adhesive pads 68 is distributed along the associated sheet 46. The shoes 18 may comprise any shoe worn on a user's feet.

A motor 70 is positioned within the housing 12 and the motor 70 is positioned adjacent to the first roller 42. The motor 70 may comprise an electrical motor or the like. A first gear 72 is rotatably coupled to the motor 70 and the motor 70 rotates the first gear 72 when the motor 70 is turned on. A second gear 74 is coupled to the first roller 42 such that the second gear 74 engages the first gear 72. The motor 70 rotates the first roller 42 such that each of the sheets 46 is selectively rolled onto the first roller 42 from the second roller 44.

A switch 76 is hingedly coupled to the housing 12 and the switch 76 may be manipulated. The switch 76 may be positioned on the back side 34 of the housing 12. The switch 76 is electrically coupled to the motor 70 such that the switch 76 turns the motor 70 on and off. The switch 76 may comprise a foot pedal or the like. The switch 76 actuates the motor 70 to rotate in a first direction such that the sheet 46 is rolled onto the first roller 42.

A button 78 is coupled to the housing 12 and the button 78 may be manipulated. The button 78 is electrically coupled to motor. The button 78 may be positioned on the front side 32 of the housing 12. A power supply 80 is positioned within the housing 12. The power supply 80 is electrically coupled to the switch 76. The power supply 80 comprises at least one battery 82.

In use, the housing 12 is positioned adjacent to an entry into the area. The user steps on the switch 76 to advance the perforated sections 56 of the adhesive pads 22 into the associated openings 16. The user steps into each of the openings 16 such that the adhesive layer 55 adhesively engages the sole 24 of the shoes 18. Each of the shoes 18 may be urged to frictionally engage the bounding surface 36 of the associated openings 16. Thus, the perforated sections 56 are wrapped upwardly along the shoes 18 if the perforated sections 56 are wider or longer than the shoes 18. The user steps out of each of the openings 16 and the perforated sections 56 are removed from the associated sheets 46.

The first portion 60, the second portion 62 and the third portion 64 of the perforated section 56 are removed with a maximum sized shoe 18. The first portion 60 and the second portion 62 are removed with a medium sized shoe 18. Only the first portion 60 is removed with a minimum sized shoe 18. The adhesive pads 22 on each of the shoes 18 inhibit the shoes 18 from getting the area dirty when the user walks in the area. The adhesive pads 22 are removable from the shoes 18 at any selected time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe cleaning assembly comprising:

a housing being configured to be positioned on a support surface, said housing having a pair of openings therein wherein each of said openings is configured to have a pair of shoes placed therein while the shoes are being worn; and a dispensing unit being positioned within said housing, said dispensing unit including a plurality of adhesive pads, said plurality of adhesive pads being aligned with said openings wherein a selected one of said adhesive pad is configured to adhere to a sole of the pair of shoes when the shoes are positioned within said openings thereby inhibiting the sole of the pair of shoes from releasing dirt into an area.

2. The assembly according to claim 1, wherein said housing has a bottom wall, a top wall and a peripheral wall extending between said bottom wall and said top wall, said peripheral wall having a front side and a back side, said top wall having each of said openings extending therthrough, said openings being spaced apart from each other, each of said openings extending substantially between said front side and said back side, each of said openings having a bounding surface, said bounding surface of each of said openings being continuous such that each of said openings has an ovoid shape.

3. The assembly according to claim 2, wherein said housing includes a pair of platforms, each of said platforms being positioned within said housing, each of said platforms having a top side, said top side of each of said platforms being aligned with an associated one of said openings wherein said top side of each of said platforms is configured to be stood upon, said top side of each of said platforms being spaced from said top wall of said housing.

4. The assembly according to claim 1, wherein said dispensing unit comprises:

a first roller being rotatably coupled to said housing, said first roller being positioned within an interior of said housing, said first roller being coextensive with a front side; and a second roller being rotatably coupled to said housing, said second roller being positioned within said interior of said housing, said second roller being coextensive with a back side.

5. The assembly according to claim 4, further comprising:

a pair of openings;

a platform having a top side; and a pair of sheets, each of said sheets being rolled around said second roller, said sheets being spaced apart from each other such that each of said sheets is aligned with and associated one of said openings, each of said sheets extending between said top side of said platform and a top wall of said housing such that each of said sheets extends across an entire length of said associated opening, each of said sheets being coupled to said first roller, each of said sheets having an upper surface being exposed in said associated opening.

6. The assembly according to claim 1, wherein each of said plurality of adhesive pads has a top surface and a bottom surface, said top surface of each of said adhesive pads comprising an adhesive layer, each of said adhesive pads having a perforated section, said perforated section having a bounding surface, said bounding surface of said perforated section being continuous such that said perforated section has an ovoid shape, said perforated section being longitudinally divided into a first portion, a second portion and a third portion, each of said first portion, said second portion and said third portion of said perforated section being configured to accommodate a variety of sizes of the shoes.

7. The assembly according to claim 6, wherein:

said dispensing unit includes a pair of sheets, each of said sheets having an upper surface; and said adhesive pads comprise a first set of said adhesive pads and a second set of said adhesive pads, said bottom surface corresponding to first set of adhesive pads being removably coupled to said upper surface of an associated one of said sheets wherein said top surface corresponding to said first set of adhesive pads is configured to be stepped upon, said adhesive layer corresponding to said first set of adhesive pads being configured to adhesively engage the sole of an associated one of the shoes.

8. The assembly according to claim 7, wherein said bottom surface corresponding to second set of adhesive pads being removably coupled to said upper surface of an associated one of said sheets wherein said top surface corresponding to said second set of adhesive pads is configured to be stepped upon, said adhesive layer corresponding to said second set of adhesive pads being configured to adhesively engage the sole of an associated one of the shoes.

9. The assembly according to claim 4, further comprising:

a pair of sheets;

a motor being positioned within said housing, said motor being positioned adjacent to said first roller;

a first gear being rotatably coupled to said motor such that said motor rotates said first gear when said motor is turned on; and a second gear being coupled to said first roller such that said second gear engages said first gear, said motor rotating said first roller such that each of said sheets is selectively rolled onto said first roller from said second roller.

10. The assembly according to claim 9, further comprising a switch being hingedly coupled to said housing wherein said switch is configured to be manipulated, said switch being electrically coupled to said motor such that said switch turns said motor on and off.

11. The assembly according to claim 10, further comprising a power supply being positioned within said housing, said power supply being electrically coupled to said switch, said power supply comprising at least one battery.

12. A shoe cleaning assembly comprising:

a housing being configured to be positioned on a support surface, said housing having a pair of openings therein wherein each of said openings is configured to have a pair of shoes placed therein while the shoes are being worn, said housing having a bottom wall, a top wall and a peripheral wall extending between said bottom wall and said top wall, said peripheral wall having a front side and a back side, said top wall having each of said openings extending therthrough, said openings being spaced apart from each other, each of said openings extending substantially between said front side and said back side, each of said openings having a bounding surface, said bounding surface of each of said openings being continuous such that each of said openings has an ovoid shape, said housing including a pair of platforms, each of said platforms being positioned within said housing, each of said platforms having a top side, said top side of each of said platforms being aligned with an associated one of said openings wherein said top side of each of said platforms is configured to be stood upon, said top side of each of said platforms being spaced from said top wall of said housing; and a dispensing unit being positioned within said housing, said dispensing unit including a plurality of adhesive pads, said plurality of adhesive pads being aligned with said openings wherein a selected one of said adhesive pad is configured to adhere to a sole of the pair of shoes when the shoes are positioned within said openings thereby inhibiting the sole of the pair of shoes from releasing dirt into an area, said dispensing unit comprising:

a first roller being rotatably coupled to said housing, said first roller being positioned within an interior of said housing, said first roller being coextensive with said front side, a second roller being rotatably coupled to said housing, said second roller being positioned within said interior of said housing, said second roller being coextensive with said back side, a pair of sheets, each of said sheets being rolled around said second roller, said sheets being spaced apart from each other such that each of said sheets is aligned with and associated one of said openings, each of said sheets extending between said top side of said platform and said top wall of said housing such that each of said sheets extends across an entire length of said associated opening, each of said sheets being coupled to said first roller, each of said sheets having an upper surface being exposed in said associated opening, each of said plurality of adhesive pads having a top surface and a bottom surface, said top surface of each of said adhesive pads comprising an adhesive layer, each of said adhesive pads having a perforated section, said perforated section having a bounding surface, said bounding surface of said perforated section being continuous such that said perforated section has an ovoid shape, said perforated section being longitudinally divided into a first portion, a second portion and a third portion, each of said first portion, said second portion and said third portion of said perforated section being configured to accommodate a variety of sizes of the shoes, said adhesive pads comprising a first set of said adhesive pads and a second set of said adhesive pads, said bottom surface corresponding to first set of adhesive pads being removably coupled to said upper surface of an associated one of said sheets wherein said top surface corresponding to said first set of adhesive pads is configured to be stepped upon, said adhesive layer corresponding to said first set of adhesive pads being configured to adhesively engage the sole of an associated one of the shoes, said bottom surface corresponding to second set of adhesive pads being removably coupled to said upper surface of an associated one of said sheets wherein said top surface corresponding to said second set of adhesive pads is configured to be stepped upon, said adhesive layer corresponding to said second set of adhesive pads being configured to adhesively engage the sole of an associated one of the shoes, a motor being positioned within said housing, said motor being positioned adjacent to said first roller, a first gear being rotatably coupled to said motor such that said motor rotates said first gear when said motor is turned on, a second gear being coupled to said first roller such that said second gear engages said first gear, said motor rotating said first roller such that each of said sheets is selectively rolled onto said first roller from said second roller, a switch being hingedly coupled to said housing wherein said switch is configured to be manipulated, said switch being electrically coupled to said motor such that said switch turns said motor on and off, and a power supply being positioned within said housing, said power supply being electrically coupled to said switch, said power supply comprising at least one battery.

* * * * *